US012440722B2

(12) United States Patent
Lin et al.

(10) Patent No.: US 12,440,722 B2
(45) Date of Patent: Oct. 14, 2025

(54) TREADMILL FRAME FOR REALIZING FOLDING AND SLOPE LIFTING OF TREADMILL PLATFORM

(71) Applicant: SUNLINK (XIAMEN) SPORTS EQUIPMENTS INDUSTRIAL CO., LTD., Fujian (CN)

(72) Inventors: Xiqun Lin, Fujian (CN); Chuanwen Chen, Fujian (CN)

(73) Assignee: SUNLINK (XIAMEN) SPORTS EQUIPMENTS INDUSTRIAL CO., LTD., Xiamen (CN)

( * ) Notice: Subject to any disclaimer, the term of this patent is extended or adjusted under 35 U.S.C. 154(b) by 175 days.

(21) Appl. No.: 18/237,892

(22) Filed: Aug. 24, 2023

(65) Prior Publication Data

US 2024/0207673 A1 Jun. 27, 2024

(30) Foreign Application Priority Data

Dec. 27, 2022 (CN) ..... 202211685046.2

(51) Int. Cl.
*A63B 22/02* (2006.01)

(52) U.S. Cl.
CPC ..... *A63B 22/02* (2013.01); *A63B 2225/093* (2013.01)

(58) Field of Classification Search
CPC ..... A63B 22/02; A63B 2225/093
See application file for complete search history.

(56) References Cited

U.S. PATENT DOCUMENTS

| | | | | |
|---|---|---|---|---|
| 5,868,648 | A * | 2/1999 | Coody | A63B 22/02 482/54 |
| 6,261,209 | B1 * | 7/2001 | Coody | A63B 22/0023 482/54 |
| 6,746,374 | B2 * | 6/2004 | Chang | A63B 22/02 482/54 |
| 6,811,518 | B2 * | 11/2004 | Lin | A63B 22/02 482/54 |
| 6,913,562 | B2 * | 7/2005 | Chen | A63B 22/02 482/54 |
| 7,381,160 | B2 * | 6/2008 | Lo | A63B 22/02 482/54 |
| 9,707,441 | B2 * | 7/2017 | Yang | A63B 22/02 |
| 2005/0037898 | A1 * | 2/2005 | Chang | A63B 22/0023 482/52 |
| 2010/0056344 | A1 * | 3/2010 | Chu | A63B 22/02 482/54 |
| 2015/0182782 | A1 * | 7/2015 | Cutler | A63B 69/0057 403/84 |
| 2025/0041655 | A1 * | 2/2025 | Liu | A63B 21/4035 |

* cited by examiner

*Primary Examiner* — Joshua T Kennedy

(57) ABSTRACT

A treadmill frame for realizing folding and slope lifting of a treadmill platform is provided by the disclosure, including a treadmill platform, a base, a bracket, a telescopic rod and a switch piece; a running belt is arranged at a front and back of the treadmill platform; the base is under the treadmill platform and is configured to fall on a ground; a bottom end of the bracket is pivoted on the base, and a top end of the bracket is tilted backward and pivoted on a front half of the treadmill platform; the switch piece is configured to pivotally connect a front end of the treadmill platform on the base or loosen the front end of the treadmill platform from the base. Through a driving mechanism, the disclosure can simultaneously adjust the inclination of the treadmill platform and the erected folding of the treadmill platform.

5 Claims, 10 Drawing Sheets

TREADMILL FRAME FOR REALIZING FOLDING AND SLOPE LIFTING OF TREADMILL PLATFORM

CROSS-REFERENCE TO RELATED APPLICATIONS

This application claims the priority benefit of China application No. 202211685046.2, filed on Dec. 27, 2022. The entirety of the above-mentioned patent application is hereby incorporated by reference herein and made a part of this specification.

TECHNICAL FIELD

The disclosure relates to the technical field of treadmill, in particular to a treadmill frame for realizing the folding and the slope lifting of a treadmill platform.

BACKGROUND

The treadmill is usually equipped with a treadmill platform, and a running belt is arranged in front and back of the treadmill platform. The running belt rolls back during use, so the user can run forward on the running belt.

In order to simulate the climbing process in actual running, the treadmill platforms of some current treadmills are set to be able to rise and fall at the front to adjust the elevation of the treadmill platform. In order to save more space when the treadmill is not in use, the treadmill platforms of some treadmills are set to be able to fold. However, on the existing treadmill, two sets of independent driving mechanisms are used to adjust the inclination of the treadmill platform and the erected folding of the treadmill.

If the inclination of the treadmill platform and the erected folding of the treadmill platform can be realized at the same time through a driving mechanism, it will make the equipment more concise and effectively save costs.

SUMMARY

The object of the disclosure is to provide a treadmill platform that can realize the folding and slope raising of the treadmill platform, so as to overcome the above defects, and adjust the inclination of the treadmill platform and the erected folding of the treadmill platform through a driving mechanism.

To achieve the above object, the solution of the disclosure is: A treadmill frame for realizing folding and slope lifting of a treadmill platform, including a treadmill platform, a base, a bracket, a telescopic rod and a switch piece;

- a running belt is arranged at a front and back of the treadmill platform;
- the base is under the treadmill platform and is configured to fall on a ground;
- a bottom end of the bracket is pivoted on the base, and a top end of the bracket is tilted backward and pivoted on a front half of the treadmill platform;
- one end of the telescopic rod is pivoted on the base, and a pivot point of the telescopic rod and the base is located behind a pivot point of the bracket and the base, the other end of the telescopic rod is pivoted on the treadmill platform, and a pivot point of the telescopic rod and the treadmill platform is located in front of a pivot point of the bracket and the treadmill platform, so as to form a cross between the bracket and the telescopic rod;

- the switch piece is configured to pivotally connect a front end of the treadmill platform on the base or loosen the front end of the treadmill platform from the base, and a rotation shaft is coaxial with a rotation shaft of the bracket pivoted on the base, and is located in front of the pivot point of the treadmill platform and the telescopic rod.

Further, the switch piece includes a swing plate and a pin hole formed on the base that extends left and right; an axis of the pin hole is coaxial with the rotation shaft of the bracket pivoted on the base, one end of the swing plate is pivoted on the treadmill platform, and the other end of the swing plate is formed with a pin that extends left and right, and the swing plate swings left and right so that the pin is inserted into or pulled out of the pin hole.

Further, a front and rear length of the base is shorter than a front and rear length of the treadmill platform, the base is located under the front of the treadmill platform, and a rear of the treadmill platform is on the ground.

Further, a bottom side of the rear of the treadmill platform is equipped with rollers for rolling back and forth.

After adopting the above solution, the advantageous effects of the disclosure are as follows:

(1) A running belt is arranged at the front and back of the treadmill platform. The base is under the treadmill platform and falls on the ground. The bottom end of the bracket is pivoted on the base, the top end of the bracket is tilted backward and pivoted on the front half of the treadmill platform. One end of the telescopic rod is pivoted on the base, and the pivot point with the base is located behind the pivot point of the bracket and the base, the other end of the telescopic rod is pivoted on the treadmill platform, and the pivot point of the telescopic rod and the treadmill platform is located in front of the pivot point of the bracket and the treadmill platform, so as to form a cross between the bracket and the telescopic rod. Thus, when the telescopic rod is stretched, it will reach the front of the treadmill platform, and the treadmill platform will move upward, and then drive the front swing of the bracket to lift up. At the same time, because the front end of the treadmill platform is pushed up by the telescopic rod, the treadmill platform will turn back around the pivot joint of the bracket, and then the treadmill platform will form a high front and low rear elevation.

(2) The switch piece is configured to pivotally connect a front end of the treadmill platform on the base or loosen the front end of the treadmill platform from the base, and a rotation shaft is coaxial with a rotation shaft of the bracket pivoted on the base, and is located in front of the pivot point of the treadmill platform and the telescopic rod. When the switch piece loosens the treadmill platform, the telescopic cylinder is used to drive the treadmill platform to adjust the elevation. When the switch piece pivotally connects the front end of the treadmill platform on the base, the treadmill platform moves with the bracket, and the rear moves up or down with the front swing of the bracket. Thus, the raising or lowering of the treadmill platform is achieved under the telescopic driving of the telescopic rod.

Description of the labels in drawings: 1—treadmill platform, 2—base, 3—bracket, 4—telescopic rod, 5—switch piece, 6—running belt, 7—swing plate, 8—pin hole, 9—pin, 10—roller, 11—handrail, 12—the rotation shaft of the bracket pivoted on the base.

DETAILED DESCRIPTION OF THE EMBODIMENTS

The present disclosure is described in detail below in combination with the attached drawings and specific embodiments.

Figure 1:
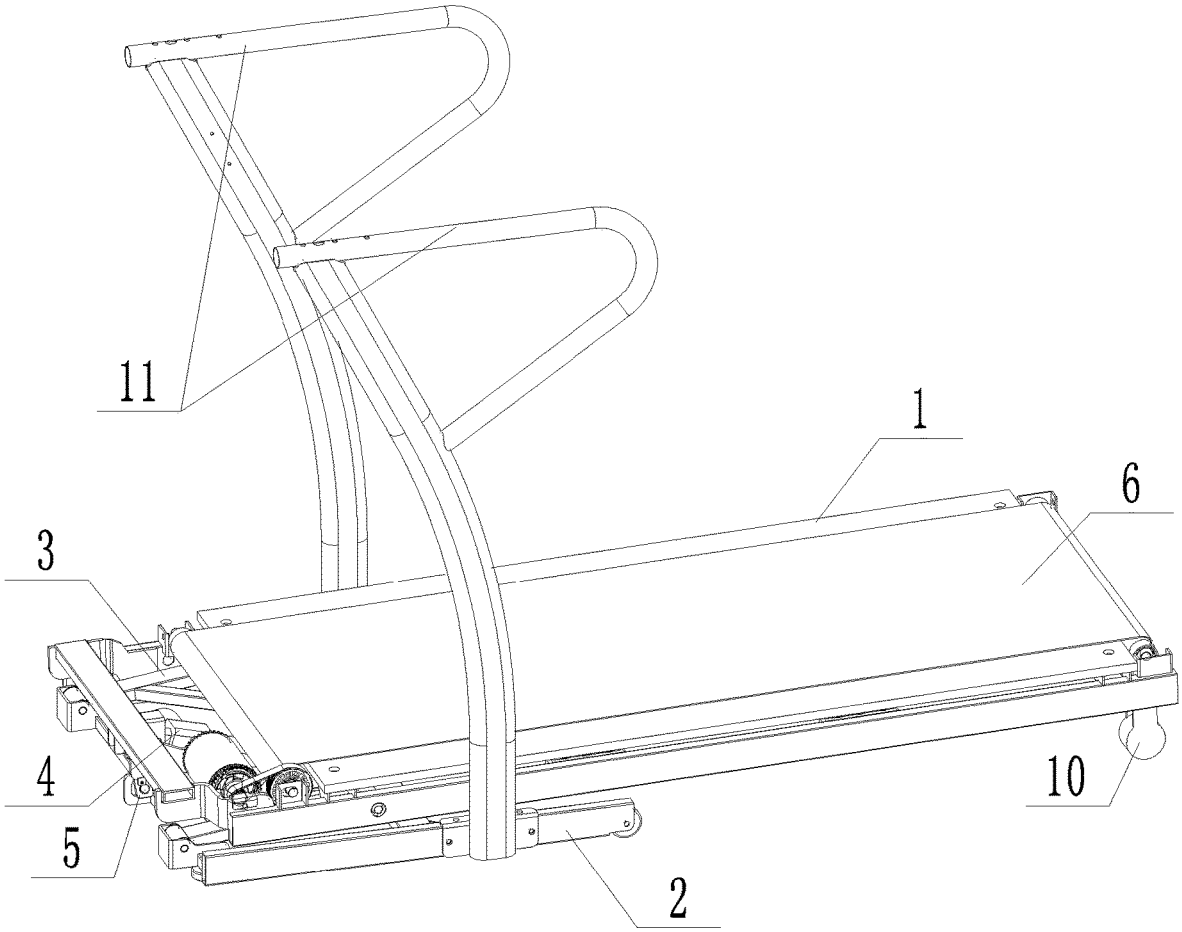
FIG. 1 is a perspective structural diagram of the treadmill platform in the horizontal state.

The present disclosure provides a treadmill frame to realize the folding and slope lifting of the treadmill platform, as shown in FIG. 1 through FIG. 11, it is mainly combined with FIG. 1 here, including a treadmill platform 1, a base 2, a bracket 3, a telescopic rod 4 and a switch piece 5.

The running belt 6 is arranged on the front and back of the treadmill platform 1. The running belt 6 is arranged on the treadmill platform 1 as a conventional setting, which will not be detailed in this embodiment.

The front and rear length of the base 2 is shorter than the front and rear length of the treadmill platform 1. The base 2 is located below the front half of the treadmill platform 1, and the specific shape is not limited, as long as it can be placed on the ground stably, the rear of the treadmill platform 1 also falls on the ground.

Figure 2:
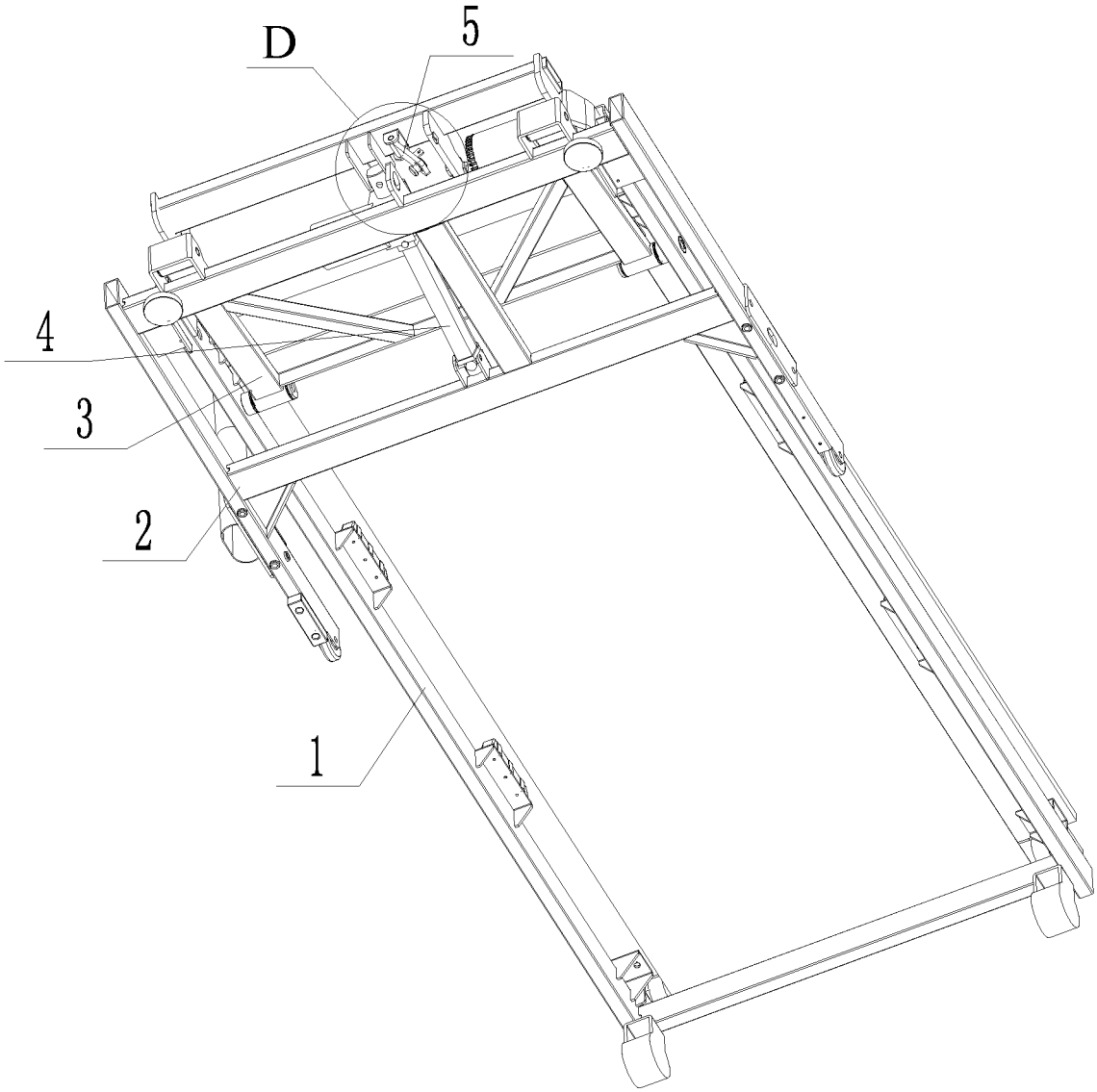
FIG. 2 is the structural diagram of the disclosure shown that the front end of the treadmill platform is lifted up when the switch piece is loose after removing the running belt and handrail of the disclosure.
Figure 5:
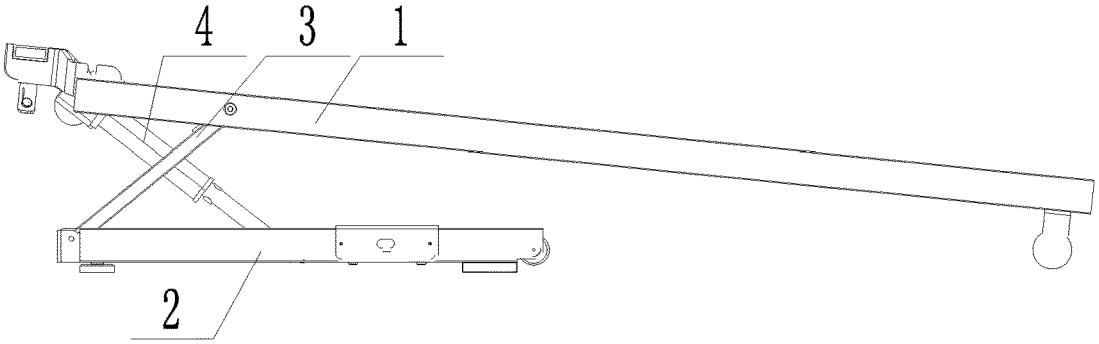
FIG. 5 is a lateral structural diagram of the disclosure shown that the front end of the treadmill platform is lifted to form an inclination angle after removing the running belt and handrail of the disclosure.

Here, in combination with FIG. 2 and FIG. 5, the left and right sides of the bottom end of bracket 3 are horizontally pivoted on the base 2. Specifically, in this embodiment, the bottom end of bracket 3 is pivoted on the front end of base 2, and the top end of bracket 3 is tilted backward and horizontally pivoted on the front half of treadmill platform 1.

Figure 4:
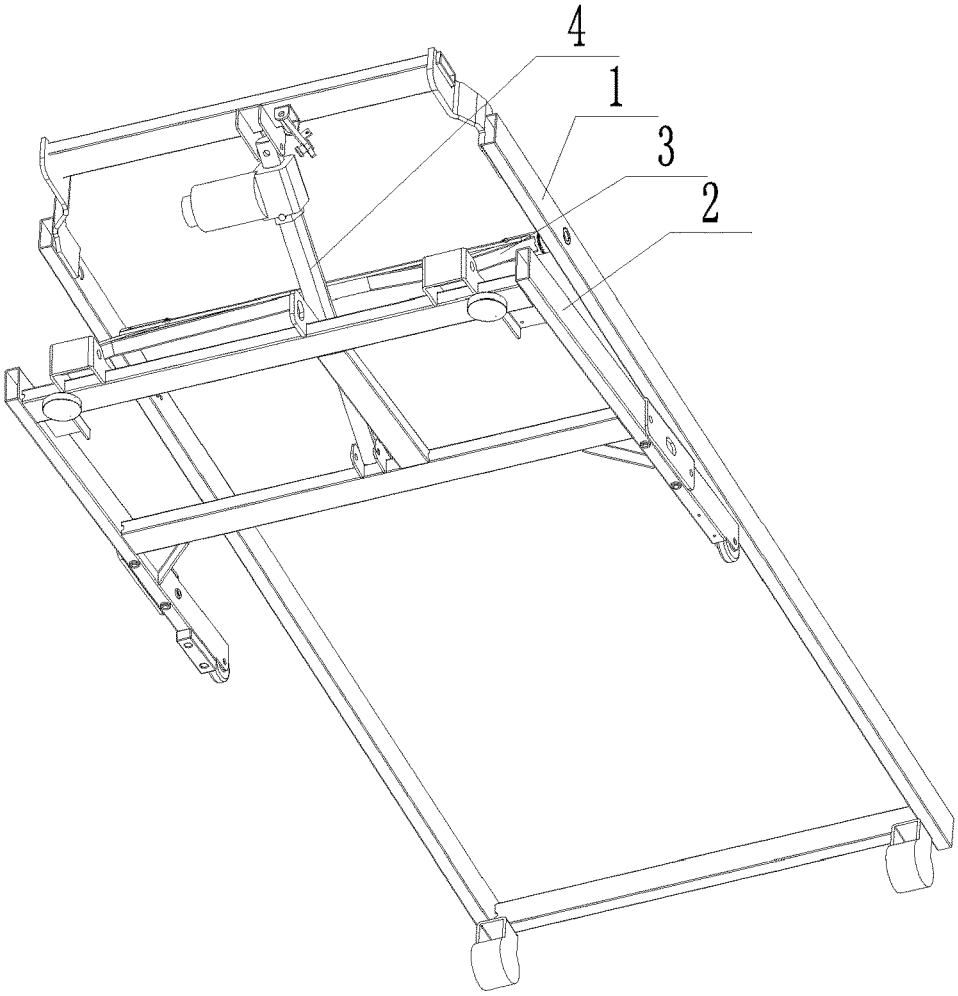
FIG. 4 is a perspective structural diagram of the disclosure shown that the front end of the treadmill platform is lifted to form an inclination angle after removing the running belt and handrail of the disclosure.
Figure 6:
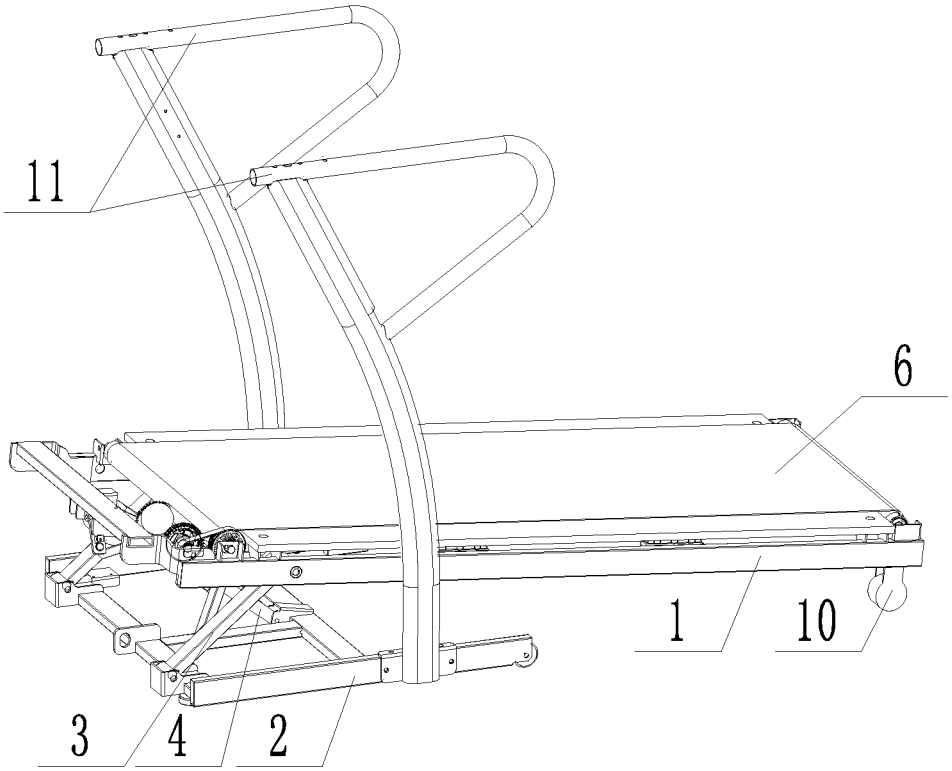
FIG. 6 is a perspective structural diagram of the disclosure shown that the front of the treadmill platform is lifted to form an inclination angle.
Figure 7:
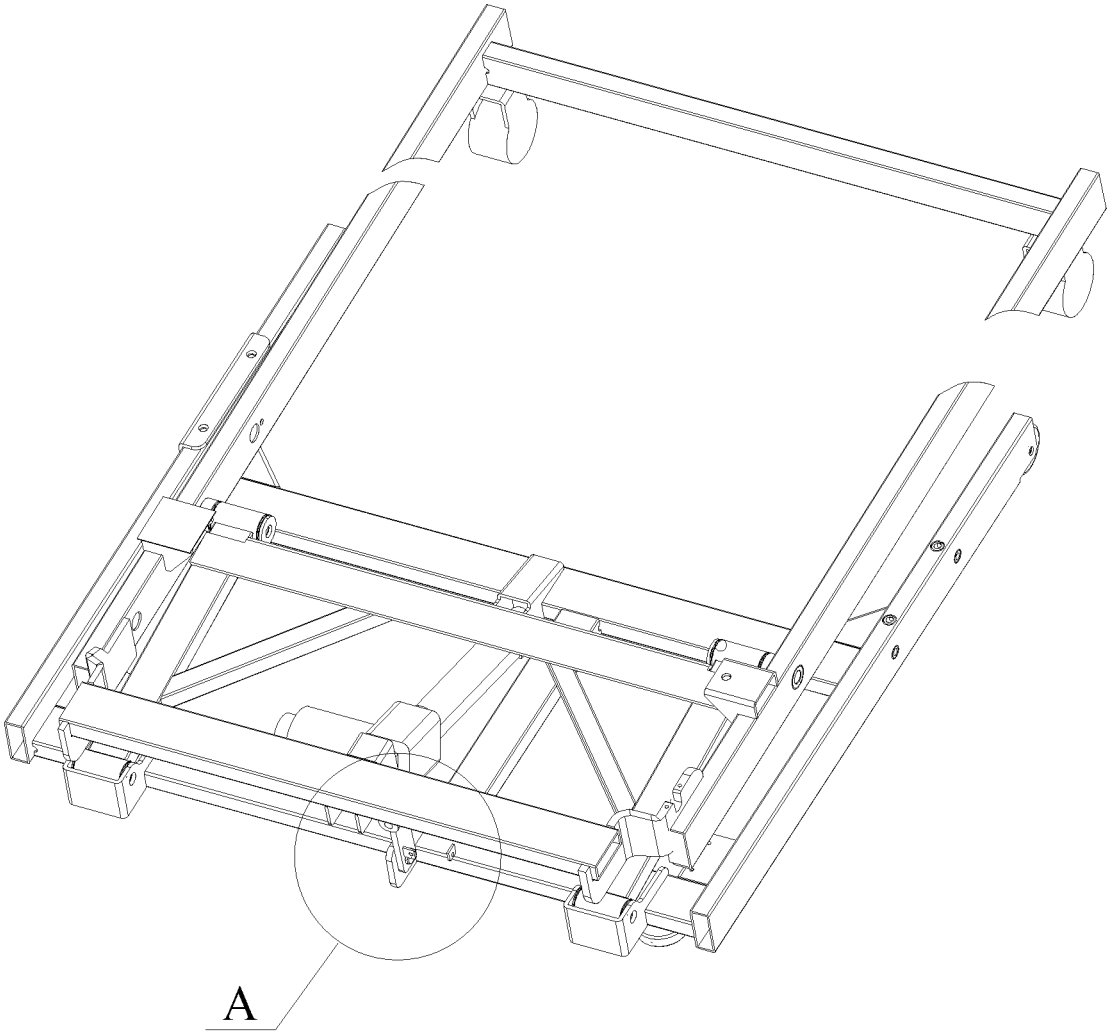
FIG. 7 is the structural diagram of the disclosure shown that the switch piece limits the lifting of the front end of the treadmill platform after removing the running belt and handrail of the disclosure.
Figure 8:
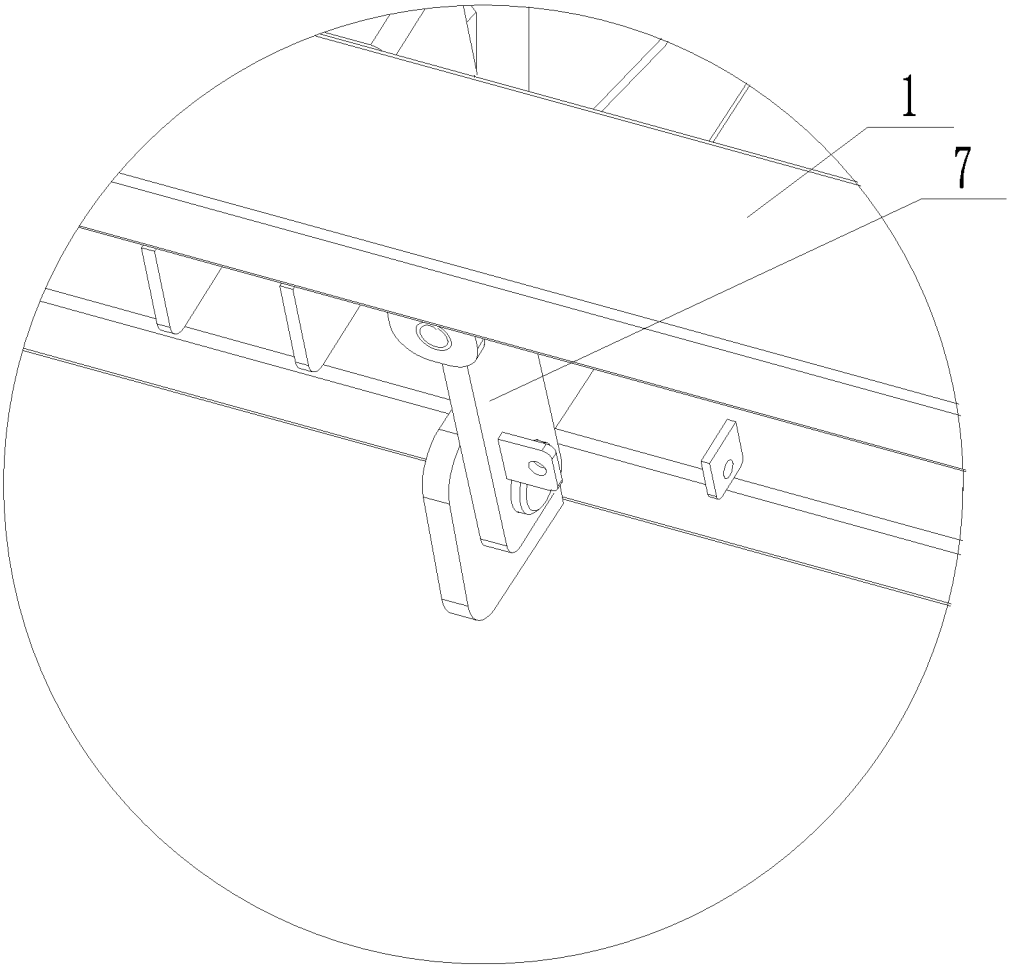
FIG. 8 is a partial enlarged view at position A in FIG. 7.

Here, as shown in FIG. 5, the telescopic rod 4 can be any existing telescopic drive mechanism, such as air cylinder, hydraulic cylinder, etc. One end of the telescopic rod 4 is pivoted on the base 2 along the left-right direction horizontally, and the pivot point with the base 2 is located behind the pivot point of the bracket 3 and the base 2. The other end of the telescopic rod 4 is pivoted on the treadmill platform 1 along the left-right direction horizontally, and the pivot point of the telescopic rod 4 and the treadmill platform 1 is located in front of the pivot point of the bracket 3 and the treadmill platform 1, so as to form a cross between the bracket 3 and the telescopic rod 4. As shown in FIG. 4 through FIG. 6, when the telescopic rod 4 is stretched, it will reach the front of the treadmill platform 1, and the treadmill platform 1 will move upward, and then drive the front swing of the top end of the bracket 3 to lift up. At this time, since the position of the telescopic rod 4 to reach the treadmill platform 1 is in front of the pivot point of the treadmill platform 1 and the bracket 3, the treadmill platform 1 turns back, and the rear still falls on the ground, only the front forms an upward lift, thus forming a high front and low rear elevation. With the stretching of the telescopic rod 4, the elevation angle of the treadmill platform 1 gradually increases. When the telescopic rod 4 shrinks, the front end of the treadmill platform 1 decreases, and the elevation angle decreases. In combination with FIG. 1 and FIG. 2, when the elevation angle decreases to zero, the treadmill platform is in horizontal state.

Figure 3:
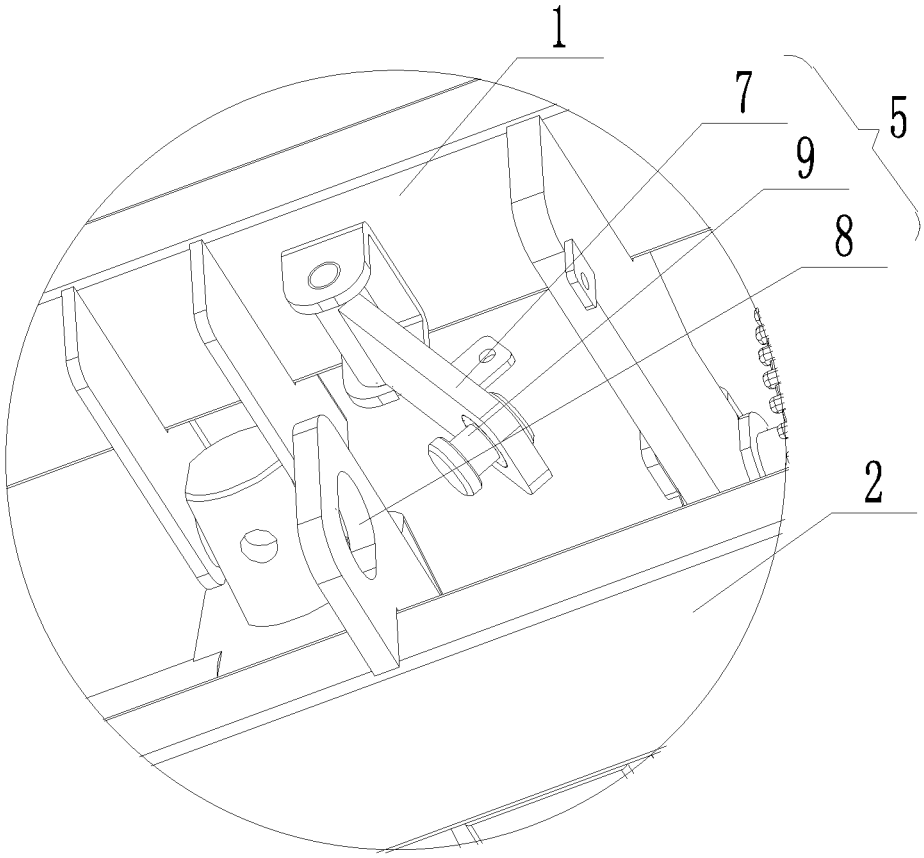
FIG. 3 is a partial enlarged view at position D in FIG. 2.
Figure 9:
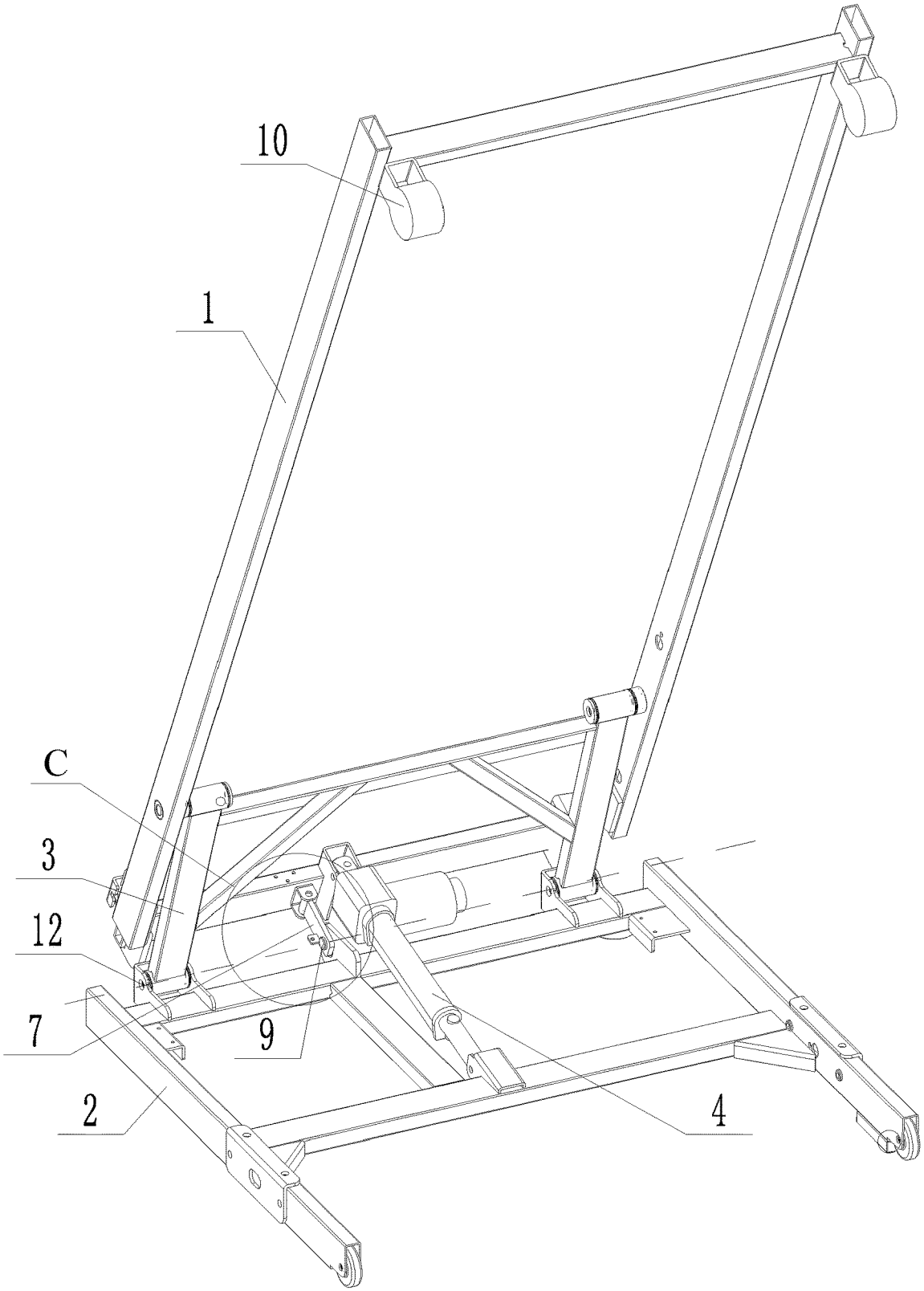
FIG. 9 is the structural diagram of the disclosure shown that the rear end of the treadmill platform is lifted up when the switch piece is loose after removing the running belt and handrail of the disclosure.
Figure 10:
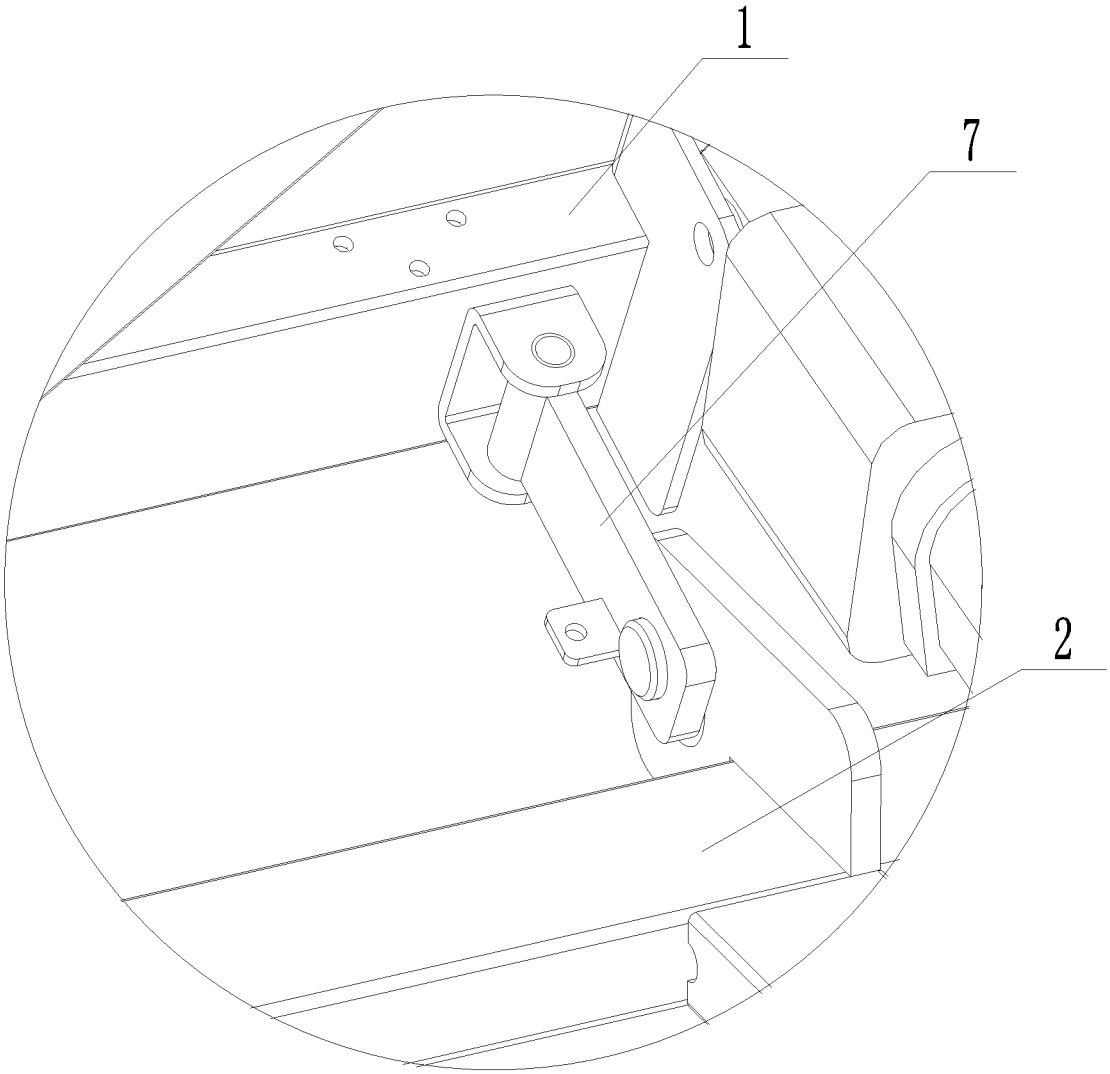
FIG. 10 is a partial enlarged view at position C in FIG. 9.
Figure 11:
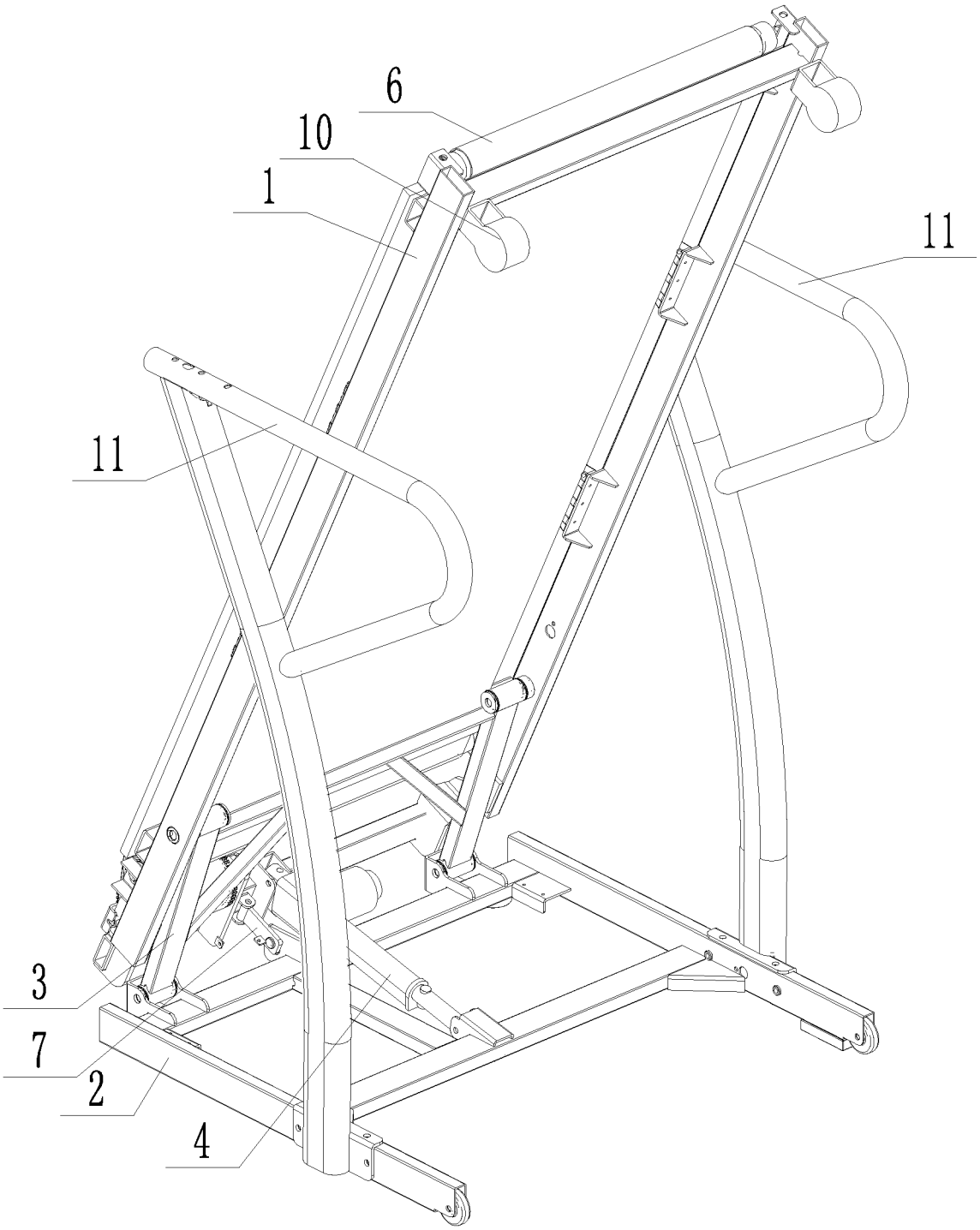
FIG. 11 a perspective structural diagram of the disclosure shown that the rear end of the treadmill platform is lifted up with the front swing of the bracket.

In combination with FIGS. 2-3 and FIGS. 7-10, the switch piece 5 is arranged at the front of the treadmill platform 1. The specific structure of the switch piece 5 is not limited. The switch piece 5 is configured to pivotally connect a front end of the treadmill platform 1 on the base 2 or loosen the front end of the treadmill platform 1 from the base 2, and a rotation shaft (the rotation shaft described here is the pivot shaft, the portion of a pin 9 which is inserted into a pin hole 8 and rotated therein, especially as shown in FIG. 9) is coaxial with a rotation shaft 12 of the bracket 3 pivoted on the base 2, and is located in front of the pivot point of the treadmill platform 1 and the telescopic rod 4. When the switch piece 5 pivots the front end of the treadmill platform 1 to the base 2, the telescopic rod 4 retracts to make the treadmill platform 1 swing synchronously with the bracket 3, so that the rear of the treadmill platform 1 moves up and erected with the front swing of the bracket 3, so as to realize the folding of the treadmill platform 1, or the rear swing drops, and falls on the ground for use. After the treadmill platform 1 is erected, the whole treadmill platform is above the base 2, which saves more space, as shown in FIG. 11. More specifically, in the embodiment, as shown in FIG. 3, the switch piece 5 includes a swing plate 7 and the pin hole 8 formed on the base 2 that extends left and right. The top of the swing plate 7 is pivoted on the bottom side of the treadmill platform 1 to swing left and right. The bottom end is formed with the pin 9 that extends left and right. The swing plate 7 swings left and right, so that the pin 9 is inserted into or pulled out of the pin hole 8. The pin 8 is coaxial with the pivot shaft of the bracket 3 on the base 2. When the pin 9 is inserted into the pin hole 8, the front end of the treadmill platform 1 can be pivoted on the base 2. When the pin 9 is pulled out of the pin hole 8, the pivot connection between the treadmill platform 1 and the base 2 can be loosened.

In the preferred embodiment, in combination with FIG. 1 and FIG. 6. Since the top of the bracket 3 also has forward displacement during the lifting process and backward displacement during the lowering process, the treadmill platform 1 is also accompanied by overall forward or backward displacement during the lifting or lowering process. The bottom side of the rear of the treadmill platform 1 is equipped with rollers 10 for forward and backward rolling.

The treadmill platform 1 falls on the ground through the support of the rollers 10. During the lifting or lowering process of the treadmill platform 1, the rollers 10 roll with the front or rear displacement of the treadmill platform 1 to reduce the friction resistance between the treadmill platform 1 and the ground.

In combination with FIG. 1, FIG. 6 and FIG. 11, in the preferred embodiment, the left and right sides of the base 2 are respectively provided with handrails 11 extending upward, and the handrails 11 extend upward to the height that is easy for the user to grasp on the treadmill platform 1. When the rear of the treadmill platform 1 is lifted to the highest position, the whole treadmill platform 1 is in the middle of the handrails 11.

The above is only a preferred embodiment of the disclosure and is not a limitation on the design of the disclosure. All equivalent changes made according to the principle of the disclosure shall be fallen into the scope of the disclosure.

The invention claimed is:

1. A treadmill frame for realizing folding and slope lifting of a treadmill platform, comprising a treadmill platform (1), a base (2), a bracket (3), a telescopic rod (4) and a switch piece (5);

a running belt (6) is arranged at a front and back of the treadmill platform (1);

the base (2) is under the treadmill platform (1) and is configured to fall on a ground;

a bottom end of the bracket (3) is pivoted on the base (2), and a top end of the bracket (3) is tilted backward and pivoted on a front half of the treadmill platform (1);

one end of the telescopic rod (4) is pivoted on the base (2), and a pivot point of the telescopic rod (4) and the base (2) is located behind a pivot point of the bracket (3) and the base (2), the other end of the telescopic rod (4) is pivoted on the treadmill platform (1), and a pivot point of the telescopic rod (4) and the treadmill platform (1) is located in front of a pivot point of the bracket (3) and the treadmill platform (1), so as to form a cross between the bracket (3) and the telescopic rod (4);

the switch piece (5) is configured to pivotally connect a front end of the treadmill platform (1) on the base (2) or loosen the front end of the treadmill platform (1) from the base (2), and a rotation shaft is coaxial with a rotation shaft of the bracket (3) pivoted on the base (2), and is located in front of the pivot point of the treadmill platform (1) and the telescopic rod (4).

2. The treadmill frame for realizing folding and slope lifting of the treadmill platform according to claim 1, wherein the switch piece (5) comprises a swing plate (7) and a pin hole (8) formed on the base (2) that extends left and right; an axis of the pin hole (8) is coaxial with the rotation shaft of the bracket (3) pivoted on the base (2), one end of the swing plate (7) is pivoted on the treadmill platform (1), and the other end of the swing plate (7) is formed with a pin (9) that extends left and right, and the swing plate (7) swings left and right so that the pin (9) is inserted into or pulled out of the pin hole (8).

3. The treadmill frame for realizing folding and slope lifting of the treadmill platform according to claim 1, wherein a front and rear length of the base (2) is shorter than a front and rear length of the treadmill platform (1), the base (2) is located under the front of the treadmill platform (1), and a rear of the treadmill platform (1) is on the ground.

4. The treadmill frame for realizing folding and slope lifting of the treadmill platform according to claim 1, wherein a bottom side of the rear of the treadmill platform (1) is equipped with rollers (10) for rolling back and forth.

5. The treadmill frame for realizing folding and slope lifting of the treadmill platform according to claim 1, wherein a left side and a right side of the base (2) are respectively provided with handrails (11), and the handrails (11) are extended upward.

* * * * *